US009983548B2

(12) United States Patent
Stranczl

(10) Patent No.: US 9,983,548 B2
(45) Date of Patent: May 29, 2018

(54) BALANCE SPRING INTENDED TO BE CLAMPED BY A RESILIENT WASHER

(71) Applicant: Nivarox-FAR S.A., Le Locle (CH)

(72) Inventor: Marc Stranczl, Nyon (CH)

(73) Assignee: Nivarox-FAR S.A., Le Locle (CH)

( * ) Notice: Subject to any disclaimer, the term of this patent is extended or adjusted under 35 U.S.C. 154(b) by 0 days. days.

(21) Appl. No.: 14/631,087

(22) Filed: Feb. 25, 2015

(65) Prior Publication Data

US 2015/0253733 A1 Sep. 10, 2015

(30) Foreign Application Priority Data

Mar. 5, 2014 (EP) ..... 14157858

(51) Int. Cl.
*G04B 17/06* (2006.01)
*G04B 17/32* (2006.01)
*G04B 17/34* (2006.01)

(52) U.S. Cl.
CPC ..... *G04B 17/32* (2013.01); *G04B 17/06* (2013.01); *G04B 17/066* (2013.01); *G04B 17/34* (2013.01); *G04B 17/345* (2013.01)

(58) Field of Classification Search
CPC ..... G04B 17/32; G04B 17/34; G04B 17/345; G04B 17/066
USPC ..... 368/175, 177
See application file for complete search history.

(56) References Cited

U.S. PATENT DOCUMENTS 3,364,673 A * 1/1968 Boult ..... G04B 17/345 368/177
3,396,450 A * 8/1968 Faehndrich ..... G04B 17/345 368/325
3,408,809 A * 11/1968 Dumont ..... G04B 17/34 368/177
4,834,603 A * 5/1989 Holton ..... B21D 22/04 411/517
5,833,422 A * 11/1998 Haga ..... F16D 1/0858 411/520
8,845,184 B2 * 9/2014 Cusin ..... G04B 13/022 368/124

(Continued)

FOREIGN PATENT DOCUMENTS

EP 1 868 045 A1 12/2007
EP 2 184 653 A1 5/2010

(Continued)

OTHER PUBLICATIONS

Stephane, EP 1868045 English Translation, Dec. 19, 2007, whole document.*

(Continued)

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A balance spring includes a strip wound around itself into several coils, the inner coil being integral with a collet including a band extending substantially in the form of a polygon. The outer contour on each bulging portion of the vertices of the polygon includes two axially extending walls substantially parallel to each other relative to the segment formed between the center of the collet and the end of the bulging portion.

15 Claims, 6 Drawing Sheets

(56) References Cited

U.S. PATENT DOCUMENTS

| | | | | |
|---|---|---|---|---|
| 2005/0219957 | A1* | 10/2005 | Lambert | G04B 17/34 368/177 |
| 2006/0055097 | A1* | 3/2006 | Conus | G04B 17/066 267/273 |
| 2009/0135679 | A1* | 5/2009 | Musy | G04B 43/002 368/177 |
| 2010/0110840 | A1 | 5/2010 | Zaugg et al. | |
| 2011/0005055 | A1* | 1/2011 | Gigandet | G04B 13/026 29/428 |
| 2011/0199866 | A1 | 8/2011 | Zaugg et al. | |
| 2013/0176834 | A1* | 7/2013 | Helfer | G04B 17/066 368/171 |
| 2014/0022873 | A1* | 1/2014 | Ching | G04B 17/066 368/175 |
| 2014/0198627 | A1* | 7/2014 | Chu | G04B 17/345 368/177 |
| 2015/0248113 | A1* | 9/2015 | Bucaille | G04B 17/06 368/175 |

FOREIGN PATENT DOCUMENTS

| | | | | |
|---|---|---|---|---|
| FR | 1.471.748 | | 3/1967 | |
| FR | 2386850 | A1 * | 11/1978 | G04B 17/345 |

OTHER PUBLICATIONS

Georges, Davione, English Translation of FR 2386850, originally published Nov. 3, 1978, full document.*

European Search Report dated Nov. 20, 2014, in Patent Application No. EP 14 15 7858, filed Mar. 5, 2014 (with English-language translation).

* cited by examiner

BALANCE SPRING INTENDED TO BE CLAMPED BY A RESILIENT WASHER

This application claims priority from European Patent application No. 14157858.3 filed Mar. 5, 2014, the entire disclosures of which is incorporated herein by reference.

FIELD OF THE INVENTION

The invention relates to a balance spring adapted to the assembly system disclosed in Patent Application Nos EP 13 187833 and EP 13 187836, namely a balance spring resiliently locked on a staff by a washer.

BACKGROUND OF THE INVENTION

Current assemblies comprising a silicon-based balance spring are generally secured by bonding. Thus a collet in one-piece with the balance spring, such as, for example, that disclosed in Patent No EP 2184653, is fitted onto a staff and then bonded at its contact points. This type of operation requires extremely delicate application which makes it expensive.

SUMMARY OF THE INVENTION

It is an object of the present invention to overcome all or part of the aforecited drawbacks by proposing a balance spring whose one-piece collet is adapted to be mounted with the aid of the assembly system disclosed in Patent Application Nos EP 13 187833 and EP 13 187836.

To this end, the invention relates to a balance spring comprising a strip wound around itself into several coils, the inner coil being integral with a collet comprising a band extending substantially in the form of a polygon, characterized in that the band comprises, at each of the vertices of said polygon, a bulging portion extending radially towards the inner coil, the point of attachment between the inner coil and the collet being situated on one of the bulging portions of the collet which is symmetrical relative to the axis passing through the centre of the collet and said point of attachment, and in that the distance between the centre of the collet and the end of each bulging portion is substantially constant in order to provide an outer contour on each bulging portion which comprises two axially extending walls substantially parallel to each other relative to the segment formed between the centre of the collet and the end of said bulging portion.

It is thus clear that the outer contour is optimised so that the resilient washer mainly clamps or tightens the balance spring on the vertices of its collet band. Indeed, even if the bulging portions are not clamped or pinched by the washer, its two substantially parallel walls, oriented substantially orthogonally relative to the peripheral wall of the washer, advantageously prevent chips forming.

In accordance with other advantageous features of the invention:

- the band is bent towards the centre of the collet between each vertex of said polygon in order to form clamping points arranged to be fitted onto a staff;
- the distances between said two walls of each bulging portion are substantially constant;
- the band includes a thickened portion extending radially from the inner wall of the band towards the centre of the collet at the vertex of said polygon comprising a point of attachment, so as to prevent displacement of the point of attachment during deformation of the band;

- the band extends substantially in the form of a triangle, a quadrilateral, a pentagon or a hexagon;
- the band extends substantially in the form of a triangle and includes, on the portion between two vertices of said triangle which is opposite said point of attachment relative to the centre of the collet, a fourth bulging portion extending radially towards the inner coil so as to position the centre of gravity of the collet at the centre of the collet;
- the balance spring includes an inner coil in a Grossmann curve and a partially thickened outer coil;
- the balance spring is made of a silicon-based material;
- the balance spring further includes a resistant, damp-proof layer to make the balance spring less sensitive to climatic variations.

Moreover, the invention relates to a resonator for a timepiece, characterized in that it includes a staff on which there is fitted a balance and a balance spring according to any of the preceding variants.

In accordance with other advantageous features of the invention:

- the balance spring is fitted onto the staff between a resilient washer and a shoulder of the staff;
- the balance spring is fitted onto the staff between a resilient washer and the balance;
- the resilient washer mainly clamps the balance spring at the vertices of its collet band.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
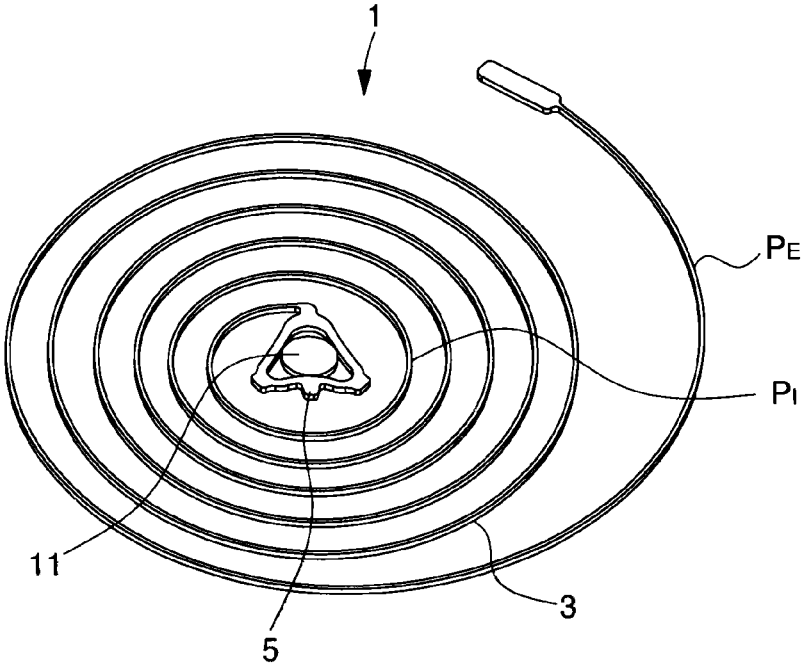
FIG. 1 is a perspective view of a balance spring according to the invention.

As explained above, the invention relates to a balance spring whose one-piece collet is adapted to the assembly system disclosed in Patent Application Nos EP 13 187833 and EP 13 187836. This assembly system is intended for a part whose material has no usable plastic domain, i.e. with a very limited plastic domain, with a member comprising a different type of material.

In the field of horology, this assembly is required due to the increasing part played by fragile materials like silicon-based materials, such as doped or non-doped single crystal (or polycrystalline) silicon like quartz or silica, single crystal or polycrystalline corundum or more generally alumina, silicon nitride and silicon carbide.

However, always having to use ordinary steel arbors or staffs, whose manufacture is mastered, is a constraint which is difficult to reconcile with the use of parts having no plastic domain. Indeed, when tests were carried out, it was impossible to drive in a steel arbor or staff and this systematically broke fragile parts, i.e. those with no or very limited usable plastic domain. For example, it became clear that the shearing generated by the metallic arbor or staff entering the aperture in a silicon component systematically breaks the component.

Thus, balance spring 1 includes a strip 3 wound around itself into several coils, the inner coil $P_I$ being integral with a collet 5, 25, 45, 65 comprising a band 7, 27, 47, 67 extending substantially in the form of a polygon. As seen in the examples of FIGS. 3, 8, 9 and 10, the band 7, 27, 47, 67 comprises a polygon in the form of a substantially constant triangle or a rhombus $L_1$, $L_2$, $L_3$, $L_4$, $L_5$, $L_6$, $L_7$, $L_8$.

However, advantageously according to the invention, band 7, 27, 47, 67 comprises, at each of the vertices of the polygon, a bulging portion 2, 4, 8, 22, 24, 26, 28, 42, 44, 48, 62, 64, 68 of respective widths $L'_2$, $L'_4$, $L'_6$, $L'_8$, extending radially towards the inner coil $P_I$, to form portions $S_1$, $S_2$, $S_3$, $S_4$ of the outer contour of the collet 5, 25, 45, 65 which are the farthest from the centre C of the collet 5, 25, 45, 65, the centre C being formed by the centre of the circle inscribed in the aperture of the collet 5, 25, 45, 65.

Figure 3:
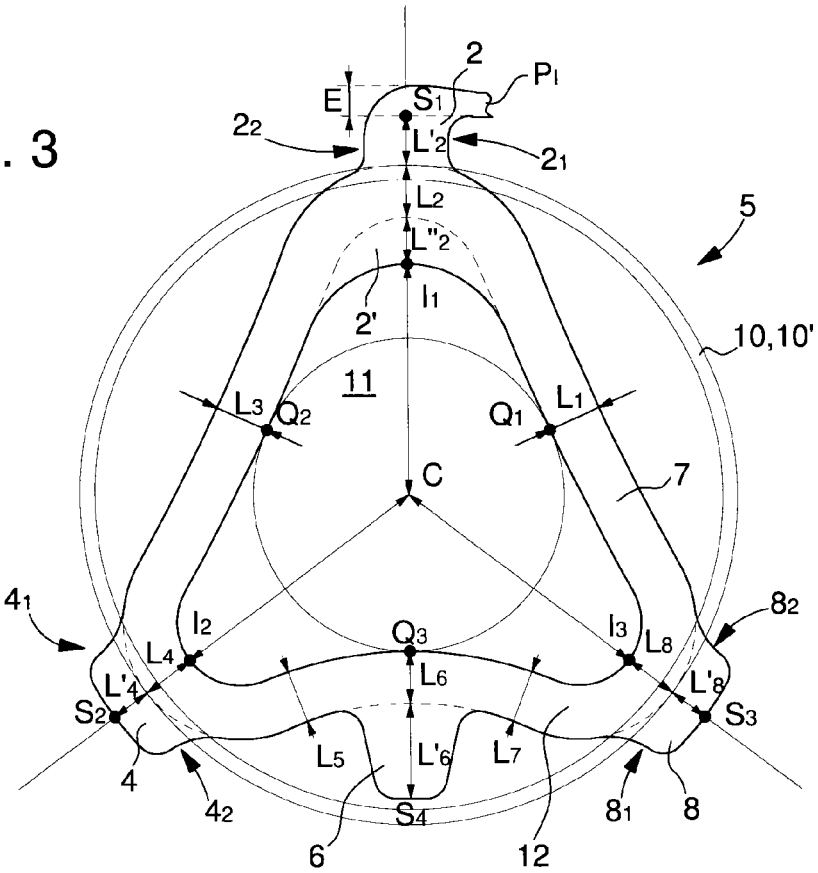
FIG. 3 is a top view of a collet according to a first embodiment of the invention.
Figure 8:
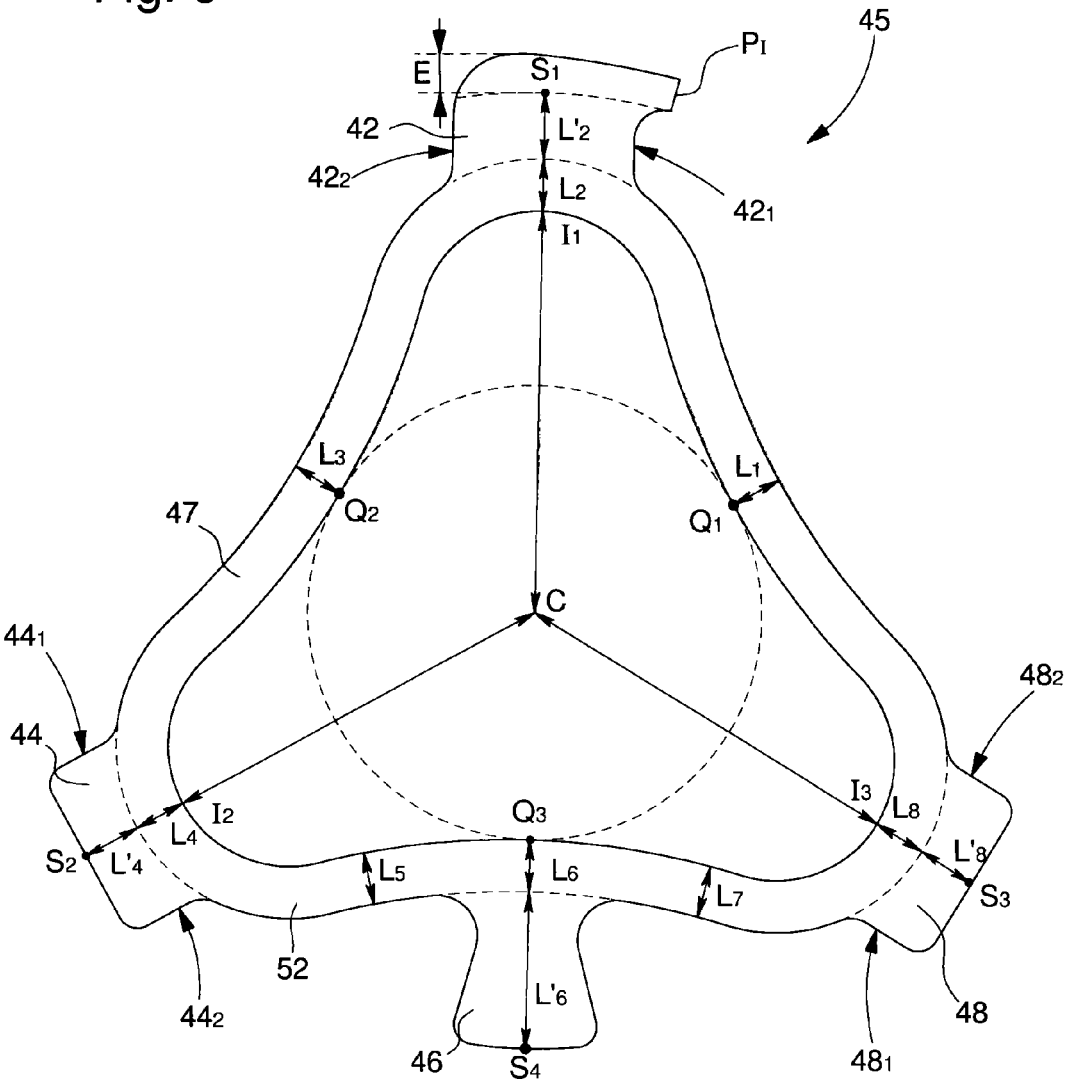
FIG. 8 is a top view of a collet according to a second embodiment of the invention.
Figure 9:
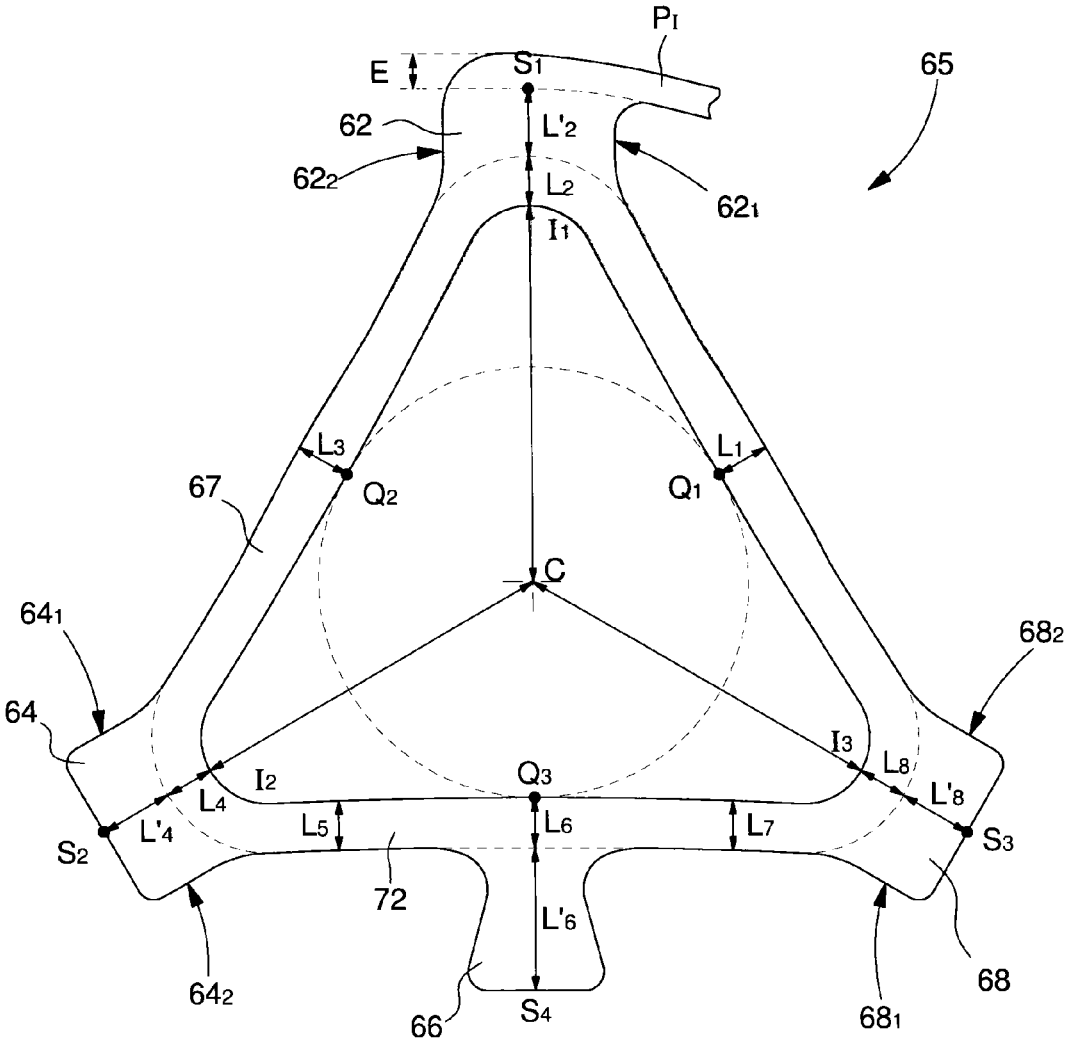
FIG. 9 is a top view of a collet according to a third embodiment of the invention.
Figure 10:
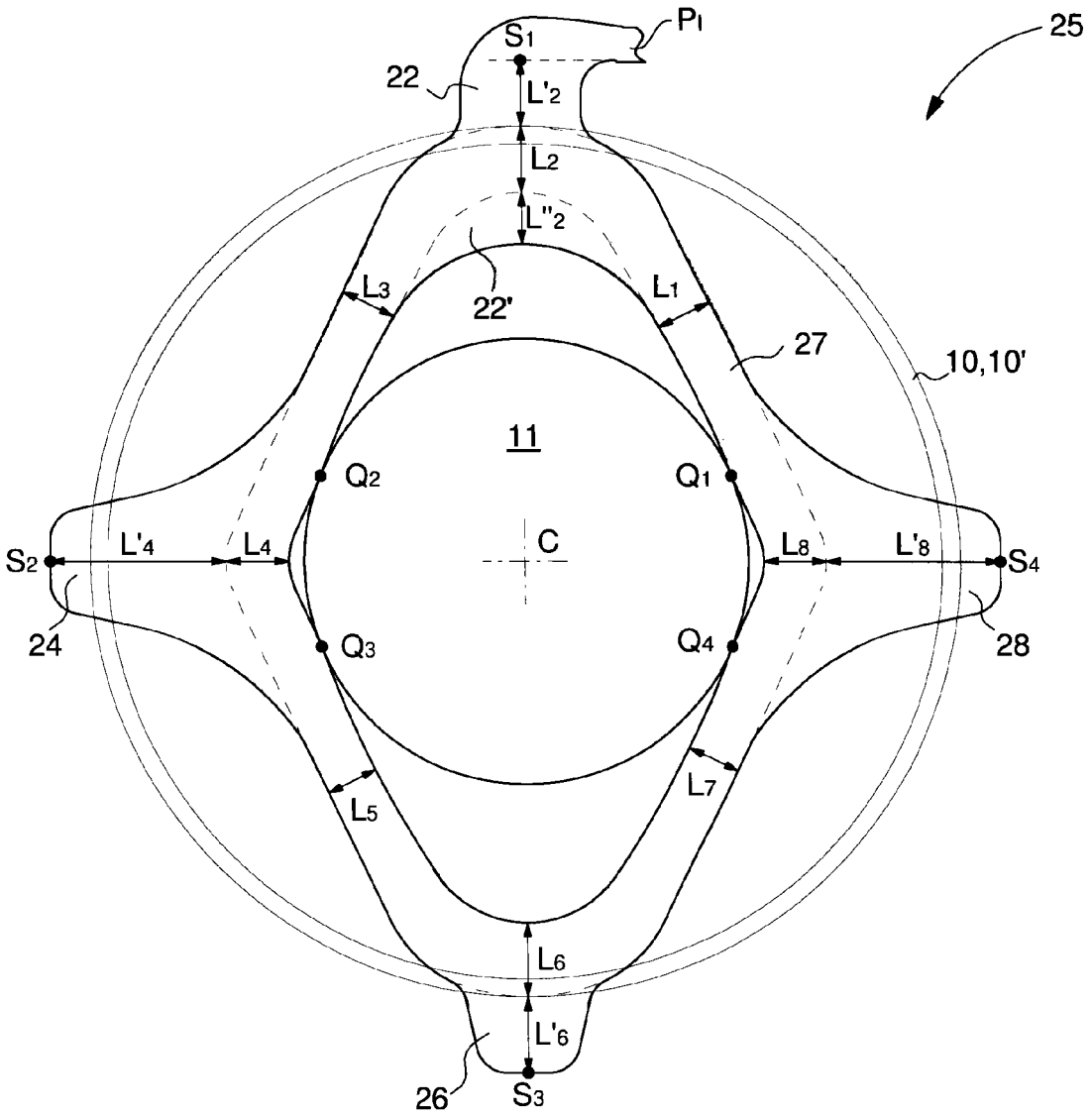
FIG. 10 is a top view of a collet according to a fourth embodiment of the invention.

To explain the invention more easily, the following explanation focusses on the embodiments of FIGS. 3, 8 and 9. However, the teachings below also apply to the embodiment of FIG. 10 and more generally to a polygon having more than three sides like a quadrilateral, such as a rhombus or a square, a pentagon or a hexagon, without departing from the scope of the invention.

Thus, as seen in FIGS. 3, 8 and 9, the point of attachment $S_1$ between the inner coil $P_I$ and the collet 5, 45, 65 is situated on one 2, 52, 72 of the bulging portions 2, 4, 8, 42, 44, 48, 62, 64, 68 of the collet 5, 45, 65. It is also noted that collet 5, 45, 65 is symmetrical relative to the axis passing through the centre C of the collet 5, 45, 65 and the point of attachment $S_1$.

Further, according to the invention, the distance between the centre C of the collet 5, 45, 65 and the end $S_1$, $S_2$, $S_3$ of each bulging portion 2, 4, 8, 42, 44, 48, 62, 64, 68 is substantially constant to provide an outer contour on each bulging portion 2, 4, 8, 42, 44, 48, 62, 64, 68 that includes two axially extending walls $\mathbf{2_1}$-$\mathbf{2_2}$, $\mathbf{4_1}$-$\mathbf{4_2}$, $\mathbf{8_1}$-$\mathbf{8_2}$, $\mathbf{42_1}$-$\mathbf{42_2}$, $\mathbf{44_1}$-$\mathbf{44_2}$, $\mathbf{48_1}$-$\mathbf{48_2}$, $\mathbf{62_1}$-$\mathbf{62_2}$, $\mathbf{64_1}$-$\mathbf{64_2}$, $\mathbf{68_1}$-$\mathbf{68_2}$ substantially parallel to each other but also parallel relative to the segment formed between the centre C of the collet and the end $S_1$, $S_2$, $S_3$ of each associated bulging portion 2, 4, 8, 42, 44, 48, 62, 64, 68.

It is seen in FIG. 3, that the distance between the two walls $\mathbf{2_1}$-$\mathbf{2_2}$ of bulging portion 2 is less than those of walls $\mathbf{4_1}$-$\mathbf{4_2}$, $\mathbf{8_1}$-$\mathbf{8_2}$ respectively of bulging portions 4 and 8, whereas in FIGS. 8 and 9, the distances between the two walls $\mathbf{42_1}$-$\mathbf{42_2}$, $\mathbf{44_1}$-$\mathbf{44_2}$, $\mathbf{48_1}$-$\mathbf{48_2}$, $\mathbf{62_1}$-$\mathbf{62_2}$, $\mathbf{64_1}$-$\mathbf{64_2}$, $\mathbf{68_1}$-$\mathbf{68_2}$ respectively of bulging portions 42, 44, 48, 62, 64, 68 are substantially constant.

Thus, although bulging portions 2, 4, 8, 42, 44, 48, 62, 64, 68 are not clamped or pinched by washer 10, the two substantially parallel walls $\mathbf{2_1}$-$\mathbf{2_2}$, $\mathbf{4_1}$-$\mathbf{4_2}$, $\mathbf{8_1}$-$\mathbf{8_2}$, $\mathbf{42_1}$-$\mathbf{42_2}$, $\mathbf{44_1}$-$\mathbf{44_2}$, $\mathbf{48_1}$-$\mathbf{48_2}$, $\mathbf{62_1}$-$\mathbf{62_2}$, $\mathbf{64_1}$-$\mathbf{64_2}$, $\mathbf{68_1}$-$\mathbf{68_2}$ thereof are oriented substantially orthogonally relative to the peripheral wall of washer 10 which advantageously prevents chips forming on the collet 5, 45, 65. It is clear, in fact, that if band 7, 47, 67 did not have these bulging portions 2, 4, 8, 42, 44, 48, 62, 64, 68 as shown in dotted lines in FIG. 3, the edge of washer 10 would be tangent with the edge of band 7, 47, 67, i.e. one perpendicular to the other, thereby risking creating too much local stress.

Preferably, according to the invention, band 7, 27, 47, 67 is bent towards the centre C of the collet 5, 25, 45, 65 between each vertex of the polygon so as to form at least three clamping or tightening points $Q_1$, $Q_2$, $Q_3$, $Q_4$ arranged to fit onto a staff 11, 11'. It is seen, in FIG. 8, that band 47 is more bent than the bands 7, 27, 67 of FIGS. 3, 9 and 10 respectively.

Further, preferably according to the invention, the band 7, 27 also includes a thickened portion 2', 22' of width $L''_2$ extending radially from the inner wall of the band 7, 27 towards the centre C of the collet 5, 25 at the vertex of the triangle comprising point of attachment $S_1$ to prevent the displacement of point of attachment $S_1$ during a deformation $F_1$ of the band 7, 27 caused by the reception of the staff 11, 11' whose section is larger than the opening between the clamping or tightening points $Q_1$, $Q_2$, $Q_3$, $Q_4$. However, it is seen in FIGS. 8 and 9 that band 47, 67 does not have this thickened portion. It is therefore clear that the thickened portion does not constitute an essential characteristic of the invention.

Finally, in FIGS. 3, 8 and 9, it is also seen that, in the portion 12, 52, 72 between two vertices of the triangle that includes bulging portions 4-8, 44-48 and 64-68 and which is opposite point of attachment $S_1$ relative to the centre C of the collet 5, 45, 65, band 7, 47, 67 comprises a fourth bulging portion 6, 46, 66 of width $L'_6$ extending radially towards the inner coil $P_I$ in order to position the centre of gravity of the collet 5, 45, 65 at the centre C of the opening of the collet 5, 45, 65.

According to an alternative to thickened portion 2', 22', to prevent the displacement of point of attachment $S_1$ during a deformation $F_1$ of the band 7, 27, 47, 67, it is also possible to vary the width of the band 7, 27, 47, 67 between the vertices of the polygon, i.e. to have a different width or a non-constant width.

FIG. 9 shows an example of non-constant width. Thus, collet 65 has an excess local thickness of around 10% at widths $L_1$ and $L_3$, i.e. at clamping or tightening points $Q_1$, $Q_2$, $Q_3$, compared to the rest of band 67, i.e. compared to widths $L_2$, $L_4$, $L_5$, $L_6$, $L_7$ and $L_8$.

By way of example, in the case of FIG. 3, if thickened portion 2' is not used, collet 5 is moved off-centre in the direction of 6 o'clock. However, for a similar geometry, FIG. 8 shows that band 47 which does not have this thickened portion, does not experience the same off-centre shift. An alternative solution to thickened portion 2', 22 for preventing the displacement of point of attachment S1 during a deformation $F_1$ of band 7, could also consist in enlarging band 7 at $L_1$, $L_3$ and or thinning band 7 at $L_5$, $L_7$ and/or decreasing the volume of the fourth bulging portion 6 and/or marking the bending of band 7 (as for collet 45).

More generally, depending on the shape of the polygon provided for collet 5, 25, 45, 65, modification of the rigidity of the collet to keep the centre of balance spring 1 coaxial to its staff 11 may be achieved by modifying the thickness of the band 7, 27, 47, 67 and/or by modifying the length of the band 7, 27, 47, 67 between the vertices of the polygon and/or by acting on the width of the bulging portions 2, 4, 6, 22, 24, 26, 28, 42, 44, 48, 62, 64, 68 or of the thickened portions 2', 22' on the band 7, 27, 47, 67 and/or by piercing the band 7, 27, 47, 67.

In FIG. 3, it is also seen that distance $C\text{-}I_1\text{-}L''_2$ is substantially equal to distances $C\text{-}I_2$ and $C\text{-}I_3$ and that distances $L_2\text{-}L'_2$, $L_4\text{-}L'_4$ and $L_8\text{-}L'_8$ are substantially equal. This explains why distances $C\text{-}S_1$, $C\text{-}S_2$ and $C\text{-}S_3$ are substantially equal in FIG. 3, whereas this equality is more immediately visible in FIGS. 8 to 10.

As explained above, balance spring 1 can thus be formed, in a non-limiting manner, from a silicon-based material, such as from doped or non-doped single crystal silicon, doped or non-doped polycrystalline silicon, doped or non-doped single crystal silicon coated with a silicon oxide, doped or non-doped polycrystalline silicon coated with a silicon oxide, silicon oxide, quartz, silica, silicon nitride coated with a silicon oxide, silicon carbide or silicon carbide coated with a silicon oxide, with no risk of the material being broken by a washer 10 10' during resilient clamping. Alternatively, balance spring 1 can also be formed, in a non-limiting manner, from single crystal corundum, polycrystalline corundum or alumina.

Figure 4:
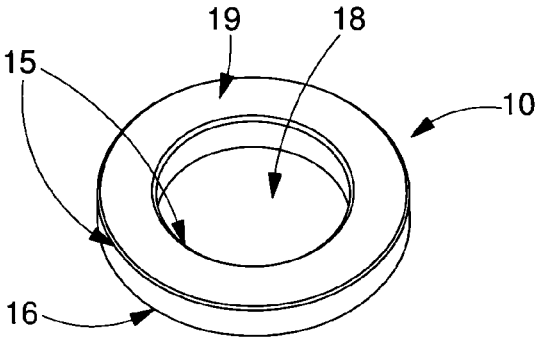
FIGS. 4 and 5 are examples of washers for fitting the balance spring according to the invention onto a staff.
Figure 5:
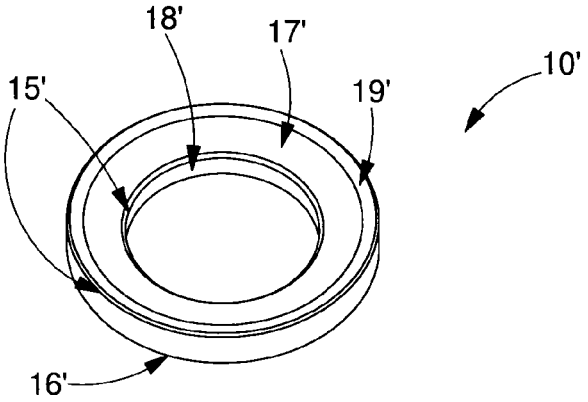
Figure 2:
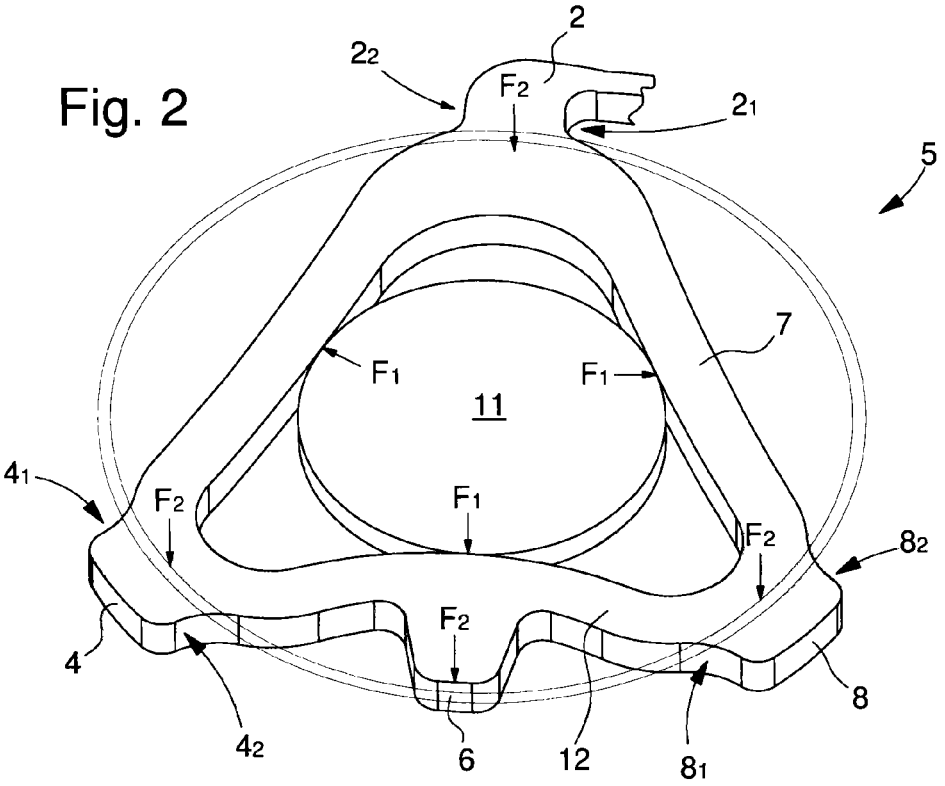
FIG. 2 is a partial diagram of FIG. 1 in which the collet is elastically deformed.

Such a washer 10, 10' is shown in FIGS. 4 and 5. In a first alternative, washer 10 is a perfect ring, i.e. a disc with an aperture 18 comprising a top surface 19 and a bottom surface 16 which can be used for clamping balance spring 1. Further, the edges of washer 10 may include chamfers 15 intended to prevent chips and rough edges forming during manufacture.

In a second alternative, washer 10' is a ring, i.e. a disc with an aperture 18', comprising a top surface 19' and a bottom surface 16'. Top surface 19' communicates with aperture 18' with the aid of a conical surface 17' and is used for clamping balance spring 1. Further, the edges of washer 10' may comprise chamfers 15' intended to prevent chips forming.

Preferably, balance spring 1 includes an inner coil $P_I$ in a Grossmann curve and an outer coil $P_E$ partially thickened to improve the concentricity of the spring during contraction and expansion.

It is also preferable for balance spring 1 to include a resistant and damp-proof layer to make the spring less sensitive to climatic variations.

Figure 6:
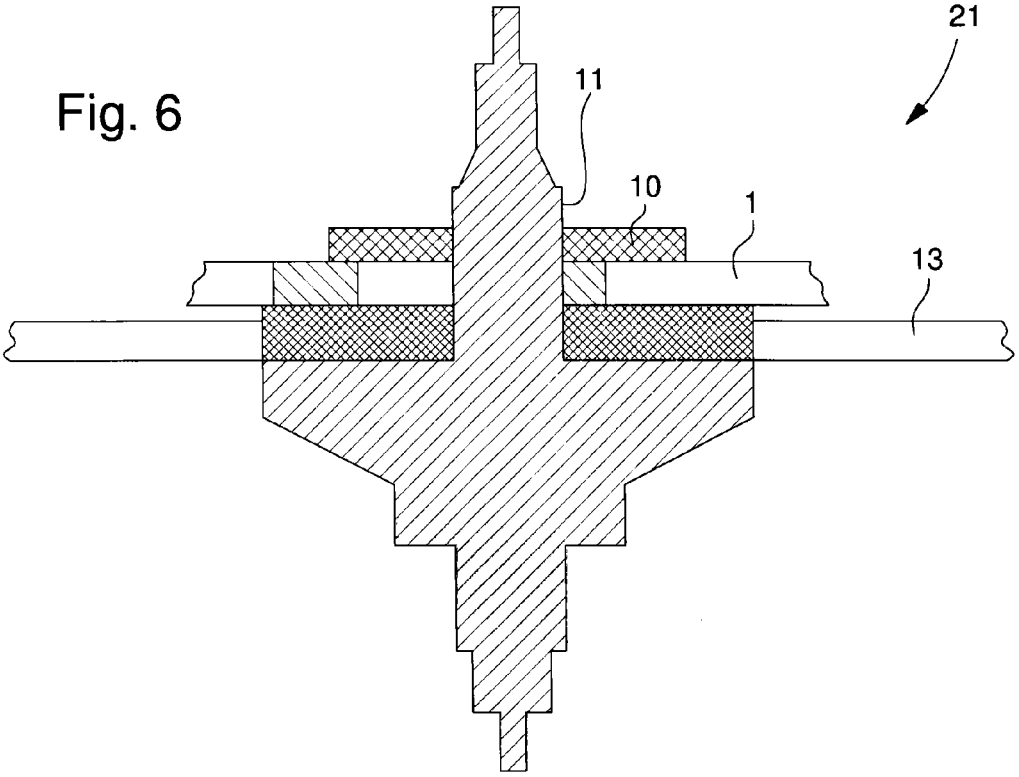
FIGS. 6 and 7 are examples of resonators according to the invention.
Figure 7:
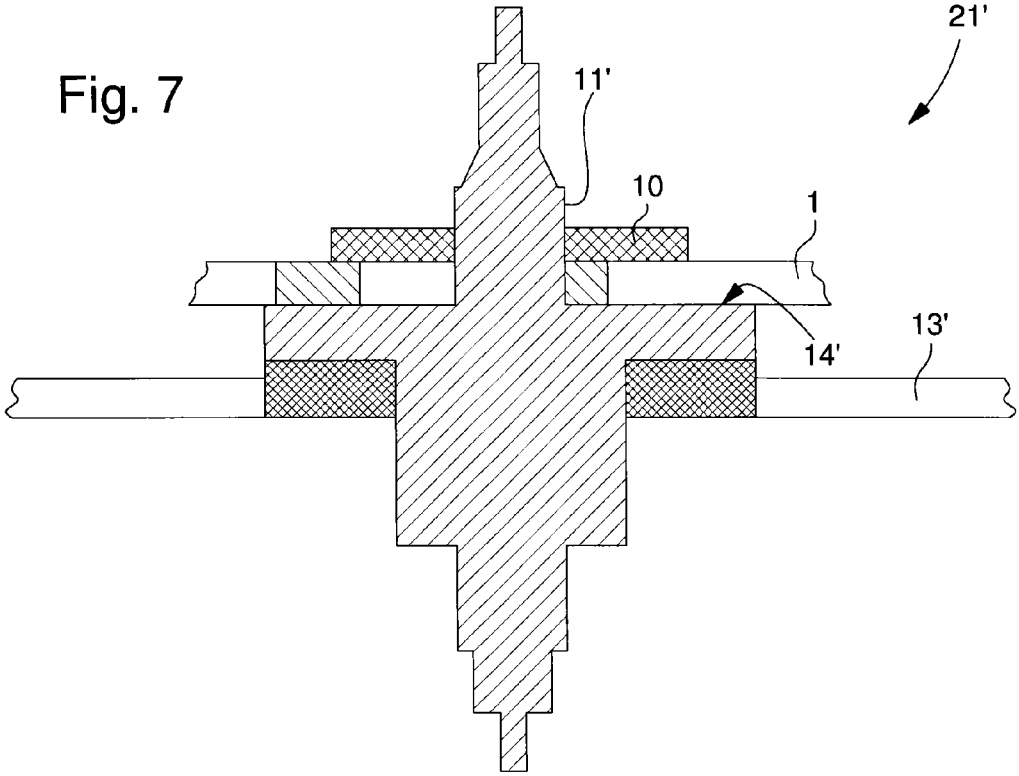

As seen in FIGS. 6 and 7, the invention also relates to a resonator 21, 21' for a timepiece comprising a staff 11, 11' to which are fitted a balance 13, 13' and the balance spring 1 according to any of the preceding variants.

Thus, in a first embodiment illustrated in FIG. 6, resonator 21 includes the balance spring 1 which is fitted onto staff 11 between a resilient washer 10 and balance 13. Whereas, in the second embodiment illustrated in FIG. 7, resonator 21' includes the balance spring 1 which is fitted onto staff 11' between a resilient washer 10 and a shoulder 14' of staff 11'.

The two resilient washer alternatives 10, 10' can be used in both embodiments. Thus, washer 10, 10' mainly clamps or pinches balance spring 1 at $F_2$ the vertices of the band 7, 27, 47, 67 of its collet 5, 25, 45, 65 but also on the fourth bulging portion 6, 26, 46, 66.

Of course, this invention is not limited to the illustrated example but is capable of various variants and modifications that will appear to those skilled in the art. In particular, the shapes and dimensions of balance spring 1 are not limited to the examples of FIGS. 1 to 10. Indeed, depending on the applications, the shapes and dimensions of balance spring 1 may differ, in particular as regards the bulging portions 2, 4, 6, 8, 22, 24, 26, 28, 42, 44, 48, 62, 64, 68 and/or the band 7, 27, 47, 67 and/or the thickened portion 2', 22' and/or the bending of the band 7, 27, 47, 67.

What is claimed is:

1. A balance spring comprising:

a strip wound around itself into several coils, an inner of the several coils coil being integral with a collet comprising a band extending substantially in the form of a triangle, wherein the band includes, at each vertex of said triangle, a bulging portion extending radially towards the inner coil such that a thickness of the collet at each bulging portion is greater than a thickness of the collet at sections extending between the bulging portions, the point of attachment between the inner coil and the collet being situated on one of the bulging portions of the collet, the collet being symmetrical relative to the axis passing through the centre of the collet and said point of attachment, wherein the distance between the centre of the collet and each of the center end points of each bulging portion are substantially the same to provide an outer contour on each bulging portion that includes two walls extending axially substantially parallel to each other but also parallel relative to a segment formed between the centre of the collet and the center end point of said bulging portion, and wherein the band comprises, on the section between two vertices of said triangle which is opposite the point of attachment relative to the centre of the collet, a fourth bulging portion extending radially towards the inner coil so as to position the centre of gravity of the collet at the centre of the collet, and bulging portions are not included between each of the other vertices of said triangle.

2. The balance spring according to claim 1, wherein the band is bent towards the centre of the collet between each vertex of said triangle so as to form at least three clamping points arranged to fit onto a staff, and the inner face of the band of the collet between each vertex is convex at least at the at least three clamping points.

3. The balance spring according to claim 1, wherein the distances between said two walls of each bulging portion are substantially constant along a length of each bulging portion.

4. The balance spring according to claim 1, wherein the band includes a thickened portion extending radially from the inner wall of the band towards the centre of the collet at the vertex of said triangle comprising the point of attachment such that a distance from the centre of the collet to the band at the vertex of the triangle comprising the point of attachment is less than a distance from the centre of the collet to the band at the vertices of the triangle that do not have the point of attachment to prevent the displacement of the point of attachment during a deformation of the band.

5. The balance spring according to claim 1, wherein the balance spring includes an inner coil in a Grossmann curve and a partially thickened outer coil.

6. The balance spring according to claim 1, wherein the balance spring is formed from a silicon-based material.

7. The balance spring according to claim 6, wherein the balance spring further includes a resistant, damp-proof layer to make the balance spring less sensitive to climatic variations.

8. A resonator for a timepiece, comprising:

a staff onto which are fitted a balance and a balance spring according to claim 1.

9. The resonator according to claim 8, wherein the balance spring is fitted onto the staff between a resilient washer and a shoulder of the staff.

10. The resonator according to claim 9, wherein the resilient washer mainly clamps the balance spring on the vertices of the band of the collet.

11. The resonator according to claim 10, wherein the resilient washer includes a conical surface that aids in clamping the balance spring.

12. The resonator according to claim 9, wherein the resilient washer includes chamfered edges.

13. The resonator according to claim 8, wherein the balance spring is fitted onto the staff between a resilient washer and the balance.

14. The balance spring according to claim 1, wherein a distance between said two walls of the bulging portion located at the vertex corresponding to the point of attachment between the inner coil and the collet is less than a distance between said two walls of each of the bulging portions located at the other vertexes of the collet.

15. The balance spring according to claim 1, wherein two walls of the fourth bulging portion are positioned such that a distance between the two walls of the fourth bulging portion increases in a direction extending away from the centre of the collet.

* * * * *